US006702419B2

(12) United States Patent
Stoessel et al.

(10) Patent No.: US 6,702,419 B2
(45) Date of Patent: Mar. 9, 2004

(54) SYSTEM AND METHOD FOR DELIVERING DROPLETS

(75) Inventors: Matthias Stoessel, Mannheim (DE); Stephan Roeger, Olfen (DE); Dirk Buchhauser, Regensburg (DE)

(73) Assignee: Osram Opto Semiconductors GmbH, Regensburg (DE)

( * ) Notice: Subject to any disclaimer, the term of this patent is extended or adjusted under 35 U.S.C. 154(b) by 0 days.

(21) Appl. No.: 10/139,703

(22) Filed: May 3, 2002

(65) Prior Publication Data

US 2003/0206207 A1 Nov. 6, 2003

(51) Int. Cl.[7] ..... B41J 29/393
(52) U.S. Cl. ..... 347/19; 382/312
(58) Field of Search ..... 347/1, 14, 19; 29/890.1; 346/23; 382/312

(56) References Cited

U.S. PATENT DOCUMENTS

| | | | | | |
|---|---|---|---|---|---|
| 3,838,274 | A | * | 9/1974 | Doubek, Jr. et al. | 250/548 |
| 5,198,054 | A | * | 3/1993 | Drake et al. | 29/890.1 |
| 5,408,746 | A | * | 4/1995 | Thoman et al. | 29/890.1 |
| 5,448,269 | A | | 9/1995 | Beauchamp et al. | 347/19 |
| 5,451,990 | A | | 9/1995 | Sorenson et al. | 347/37 |
| 5,600,350 | A | | 2/1997 | Cobbs et al. | 347/19 |
| 5,626,948 | A | * | 5/1997 | Ferber et al. | 428/195 |
| 5,764,247 | A | | 6/1998 | Asai | 347/10 |
| 5,771,050 | A | * | 6/1998 | Gielen | 347/19 |
| 6,036,297 | A | * | 3/2000 | Hayasaki | 347/13 |
| 6,145,981 | A | * | 11/2000 | Akahira et al. | 347/107 |
| 6,154,240 | A | * | 11/2000 | Hickman | 347/104 |
| 6,189,991 | B1 | * | 2/2001 | Wen et al. | 347/13 |
| 6,193,350 | B1 | | 2/2001 | Hadley | 347/19 |
| 6,228,228 | B1 | * | 5/2001 | Singh et al. | 204/192.1 |
| 6,234,602 | B1 | | 5/2001 | Soto et al. | 347/19 |
| 6,325,480 | B1 | * | 12/2001 | Moghadam et al. | 347/19 |
| 6,386,671 | B1 | * | 5/2002 | Huston et al. | 347/16 |

OTHER PUBLICATIONS

ImageXpert System Overiew, Mar. 11, 2002, http://www.imagexpert.com/pdf/IX_Sys.pdf, 9 pages total.
ImageXpert System Overiew, Mar. 11, 2002, http://www.imagexpert.com/pdf/IX_Sys.pdf, figures only 2 pages total.

* cited by examiner

*Primary Examiner*—Stephen D. Meier
*Assistant Examiner*—Blaise L Mouttet
(74) *Attorney, Agent, or Firm*—Henry J. Groth; Thomas George

(57) ABSTRACT

Systems and methods are described for delivering droplets. One embodiment provides a system comprising nozzles adapted to deliver droplets to target points on the substrate, a first camera, and means for determining an angular rotation of the substrate in a coordinate system. In some embodiments the means for determining the angular rotation includes a second camera. The substrate has a top surface and alignment marks. The nozzles have droplet delivery openings oriented towards the substrate for delivery of the droplets. The first camera is oriented substantially towards the nozzle openings, and the second camera is oriented substantially towards the substrate top surface.

26 Claims, 7 Drawing Sheets

SYSTEM AND METHOD FOR DELIVERING DROPLETS

FIELD OF THE INVENTION

The invention relates generally to a system and method for delivering droplets on a substrate. More particularly, the invention relates to aligning nozzles in ink-jet print heads with respect to target points on a substrate.

BACKGROUND OF THE INVENTION

One conventional type of printer forms characters and images on a medium, such as paper, by expelling droplets of ink in a controlled fashion so that the droplets land on the medium. Such a printer can be conceptualized as a mechanism for moving and placing the medium in a position such that the ink droplets can be placed on the medium, a printing cartridge which controls the flow of ink and expels droplets of ink to the medium, and appropriate control hardware and software. A conventional print cartridge for an inkjet type printer comprises an ink containment device and a fingernail-sized apparatus, commonly known as a print head, which heats and expels ink droplets in a controlled fashion. Other conventional inkjet type printers use piezo elements that can vary the ink chamber volume through use of the piezo-electric effect to expel ink droplets in a controlled fashion, e.g., the ink ejection device of Asai as described by U.S. Pat. No. 5,764,247. Piezoelectric nozzles are not typically implemented in cartridges, but instead are provided as nozzle arrays.

In some applications, more than one inkjet print cartridge will be designed into a printer. Usually this multiple print cartridge assembly is created to accommodate multiple colors of ink. Properly controlling the arrangement of various droplets of ink of different colors will result in a wide spectrum of perceivable colors. The clarity and quality of the resultant image is affected by the accuracy of the placement of the ink droplets on the medium. Printers that use multiple print cartridges, or alternatively an array of nozzles, to cooperatively form a single image usually require mechanical or electronic adjustment so that ink droplets printed by one nozzle align at precise locations on the receiving medium relative to those printed by another nozzle in the printer.

Cartridge-to-cartridge alignment has been eliminated in some printers with the use of a single multi-color ink cartridge having a print head employing three sets of orifices arranged in a group and receiving one color of ink for each group on the print head. Such a single multi-color print cartridge is inherently self-aligning due to the precise positioning of one set of orifices relative to another on the single orifice plate on the multi-color print cartridge. Even for this cartridge, however, unless other compensation is made, the orifice plate of the print head should be oriented precisely perpendicular to the direction of travel for accurately printed results.

Mechanical alignment of print cartridges is simple but expensive, requiring precision features created in the orifice plate of the print head, precision alignment of the cartridges during manufacture to alignment structures or secondary milling of alignment structures or adjustment within the printers cartridge carriage. In each of these foregoing implementations, there are stringent requirements on the printer and the cartridge carriage for either precision during manufacture and long-term stability, or complex adjustability and human intervention. Electronic alignment typically requires printing ink droplet dots on a separate region of the medium, scanning the medium with a detector for these dots, and then establishing time delays within the printer to compensate for the measured offsets. Again, printer complexity or human intervention and judgment are required to optimize this form of alignment.

In U.S. Pat. No. 5,448,269, Beauchamp et al. use a test pattern for multiple ink-jet cartridge alignment for bi-directional printing.

In U.S. Pat. No. 5,451,990, Sorenson et al. use specified test patterns as a reference for aligning multiple ink-jet cartridges.

In U.S. Pat. No. 5,600,350, Cobbs et al. teach multiple ink-jet print cartridge alignment by scanning a reference pattern and sampling the same with reference to a position encoder.

The method of aligning a print head provided by U.S. Pat. No. 6,193,350 by Hadley requires the creation and use of a delay time to solve the problems associated with dynamic alignment of the print head to multiple sequential targets.

Another prior art alignment technique includes mounting the print head in a fixed mechanical position. The print head is mounted to a mechanical frame which itself is mounted to the printing platform. The print head position including the position of the nozzles is known to the limit of the mechanical tolerances. The tolerances of the mechanical mounting can easily exceed the maximum tolerances required for precise ink jet printing for organic light emitting devices (typically 1–10 micrometers). The position of the nozzles within the mechanical frame of the print head can vary due to manufacturing tolerances of the print head.

The alignment system of U.S. Pat. No. 6,234,602 requires the printing of a test pattern according to a first data set, acquiring a second data set representative of the test pattern, fitting a first waveform representative of the first data set to the second data set to determine an initial fit offset value, partitioning the second data set into third data sets, fitting a measuring construct to each of the third data sets, and calculating an actual print head alignment offset value for each of the third data sets using the initial date offset with comparison data representative of comparing the measuring construct and the second data set.

Ink-jet printing has become popular as a deposition technique for the polymer, or small molecule, solutions used in organic electronics, such as organic light-emitting devices (OLEDs). One key challenge for this technique is the delivery of the solution droplets to target points of the substrate with a precision of approximately 1 to 10 micrometers. To meet this challenge, nozzles of the multi-nozzle print heads are aligned with great precision to the absolute position and the rotational angle of the substrate.

For some print head arrangements, as shown in FIG. 1, the array print head 10 is rotated with respect to the print direction (v) 12, in order to achieve a print pitch ($p_v$) 14 different from the "physical" pitch (p) 16 of the print head. Such arrangements enable a print head 10 having nozzles 18 disposed at predetermined spaced intervals to deliver droplets for a variety of target 20 separations. Unfortunately, the rotation of the print head 10 with respect to the print direction 12 renders the problem of angle alignment of the print head to the substrate targets 20 even more difficult.

But, the advantages created by this angle alignment frequently justify the effort. One advantage is that print heads 10 rotated relative to the print direction 12 enable easy adjustment of nozzle 18 spacing to compensate for thermal expansion of the substrate. Note also that a wide variety of target 20 separations can be accomplished by using different patterns of nozzles 18 disposed on a print head 10; e.g., every other nozzle, or every third nozzle.

As shown in FIG. 2, for many prior art systems the substrate 25 is located on a sample chuck and kept in position by vacuum suction or by using a mechanical clamp. For droplet deposition, either the substrate 25 is positioned on a substrate stage 27 and moved underneath the print head 10 while the print head position remains fixed, or the print head is mounted on a stage and is positioned over the substrate while the substrate is kept at a fixed position. The problem of adjusting the angle of the print head 10 and the substrate 25 rotation is described in greater detail below with reference to FIG. 4.

An automatic inkjet nozzle inspection system from ImageXpert Inc. in Nashua, N.H. acquires an image of the nozzles, but does not determine the orientation of the nozzles or nozzle plate. The ImageXpert allows for determination of the nozzle plate rotation relative to the screen of their system, but not relative to the substrate (medium).

SUMMARY OF THE INVENTION

A first aspect of the invention is implemented in embodiments that are based on a system for delivering droplets on a substrate. The system comprises nozzles adapted to deliver droplets to target points on the substrate, a first camera, and means for determining an angular rotation of the substrate in a coordinate system. In some embodiments the means for determining the angular rotation includes a second camera. The substrate has a top surface and alignment marks. The nozzles have droplet delivery openings oriented towards the substrate for delivery of the droplets. The first camera is oriented substantially towards the nozzle openings, and the second camera is oriented substantially towards the substrate top surface.

A second aspect of the invention is implemented in embodiments that are based on a method for delivering droplets on a substrate. The method comprises providing nozzles and obtaining an angular displacement value in a coordinate system. The nozzles include a first nozzle and a second nozzle. The nozzles are disposed in proximity of the substrate. The angular displacement corresponds to at least two alignment marks where the alignment marks are disposed on the substrate. The method further comprises sequentially placing the first nozzle and the second nozzle in a position in a viewing area of a first camera, registering sets of coordinates in the coordinate system, and determining an angular rotation of the first nozzle and the second nozzle in the coordinate system. The first nozzle and the second nozzle each have at least one opening for the delivery of droplets. The first camera is oriented substantially towards the nozzle openings.

A third aspect of the invention is implemented in embodiments that are based on a method for assessing the suitability of a print head having at least two nozzles for manufacturing. The print head has at least a first nozzle and a second nozzle. The first nozzle has at least one droplet delivery opening. The method comprises obtaining an angular displacement value in a coordinate system, sequentially placing the first nozzle and the second nozzle within a viewing area of a first camera, registering sets of coordinate data in the coordinate system, and comparing the sets of coordinate data and the angular rotation data to predetermined suitability values. The alignment marks disposed on a substrate. The first camera faces substantially towards the nozzle openings. Each set of coordinate data is associated with one of the nozzles. The comparing step is performed within a system for delivering droplets.

These, and other, aspects of the invention will be better appreciated and understood when considered in conjunction with the following description and the accompanying drawings. It should be understood, however, that the following description, while indicating preferred embodiments of the invention and numerous specific details thereof, is given by way of illustration and not of limitation. Many changes and modifications may be made within the scope of the invention without departing from the spirit thereof, and the invention includes all such modifications.

BRIEF DESCRIPTION OF THE DRAWINGS

A clear conception of the advantages and features constituting the invention, and of the components and operation of model systems provided with the invention, will become more readily apparent by referring to the exemplary, and therefore non-limiting, embodiments. The embodiments are illustrated in the drawings accompanying and forming a part of this specification, wherein like reference characters (if they occur in more than one view) designate the same parts. It should be noted that the features illustrated in the drawings are not necessarily drawn to scale.

DESCRIPTION OF PREFERRED EMBODIMENTS

The invention and the various features and advantageous details thereof are explained more fully with reference to the embodiments that are illustrated in the accompanying drawings and detailed in the following description of preferred embodiments. Descriptions of well-known components and processing techniques are omitted so as not to unnecessarily obscure the invention in detail.

System for Delivering Droplets

Figure 1:
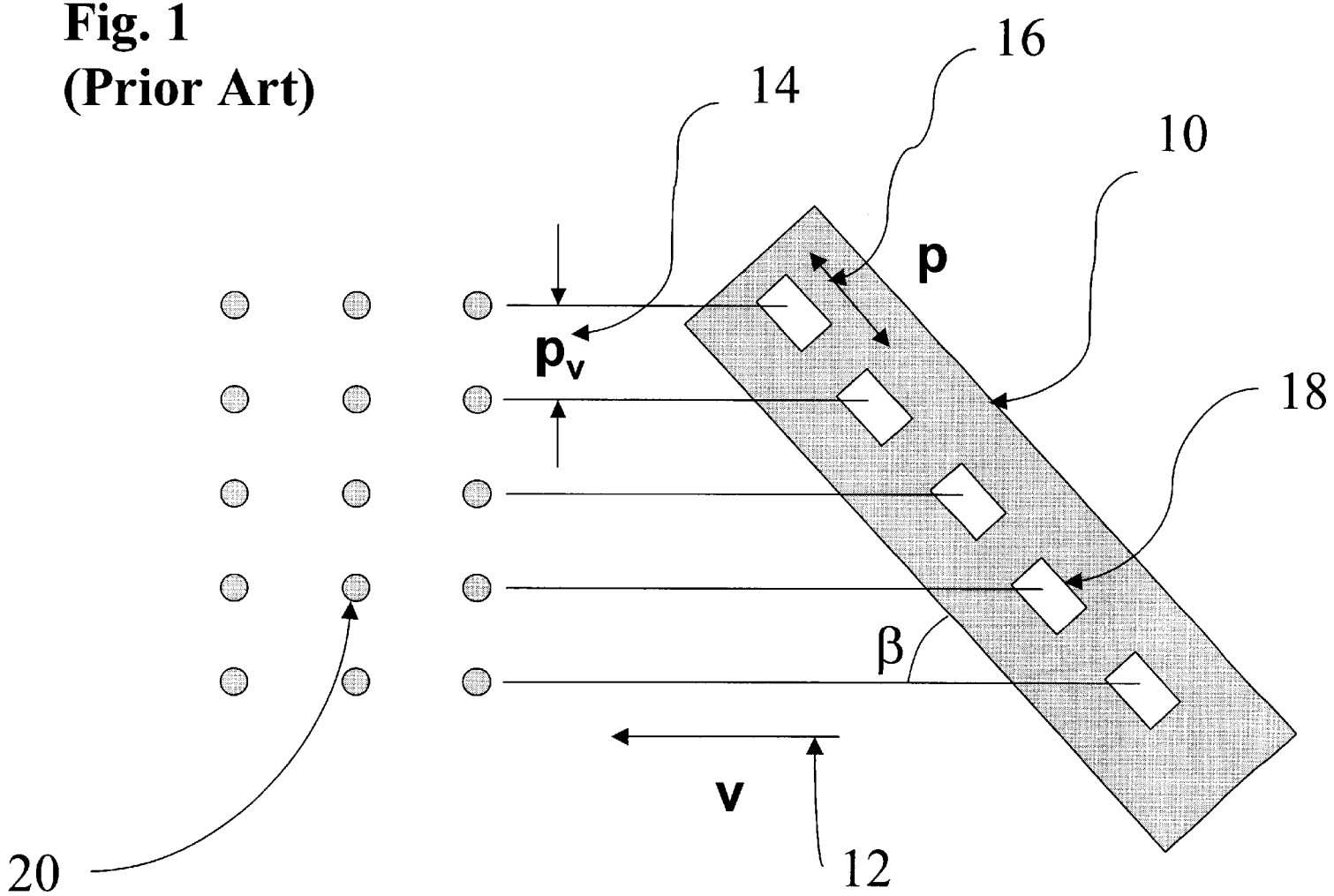
Fig. 1 (Prior Art)
FIG. 1 illustrates a print head disposed with a rotational displacement relative to a droplet target array.
Figure 3:
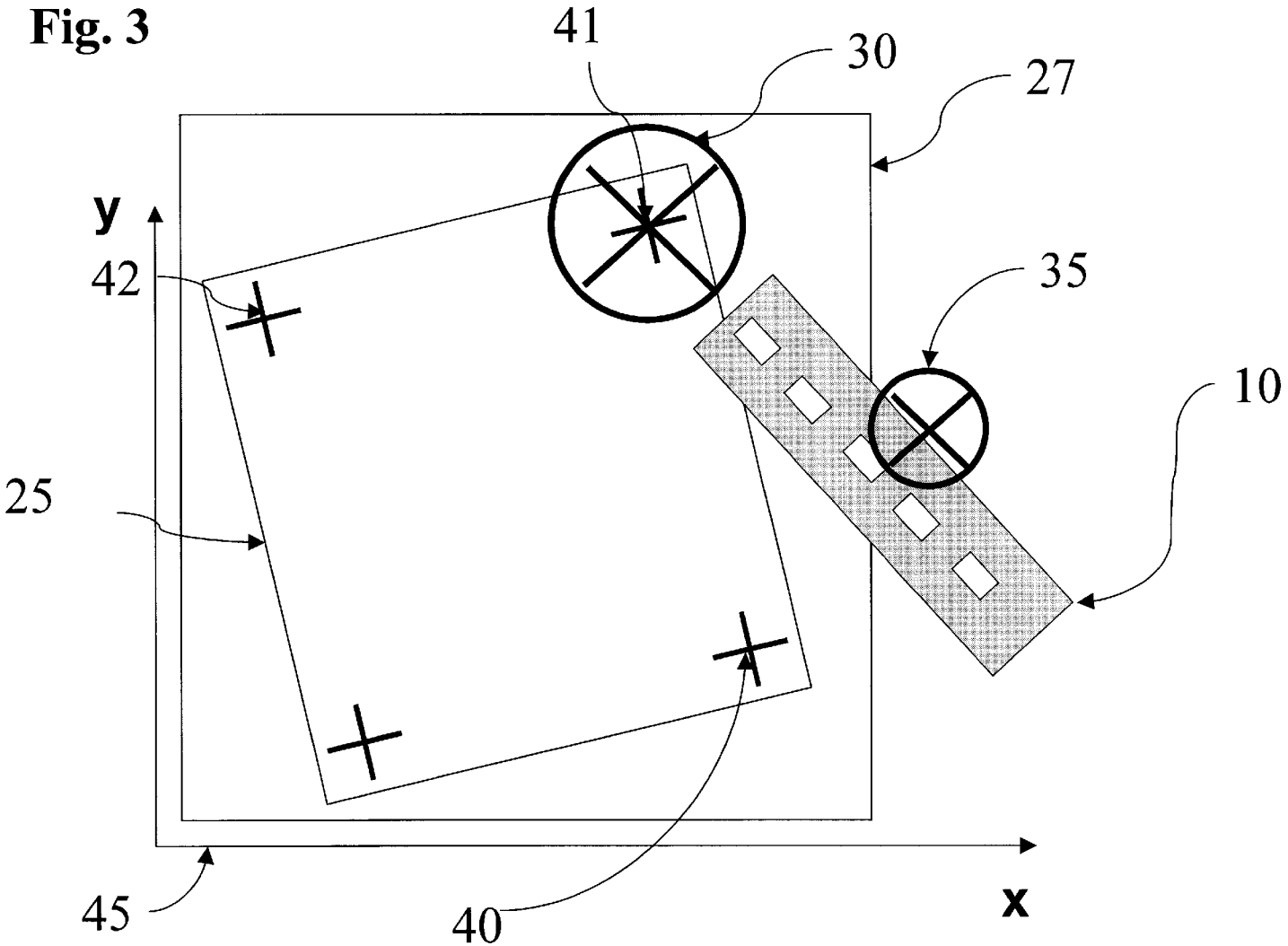
FIG. 3 illustrates the placement of the downward looking camera over an alignment mark to obtain stage coordinates x1, y1, according to a process step of one embodiment of the invention.

One embodiment of the invention, as shown in FIG. 3 provides a system for delivering droplets on a substrate 25. The system for delivering droplets includes nozzles 18 (see FIG. 1), a first camera 30, and means for determining an angular rotation of the substrate 25 in a coordinate system. Commercially available multi-nozzle print heads, such as provided by Ink Jet Technology, Inc. or Spectra Inc. can be used to implement this embodiment. In some embodiments, the angular rotation of the substrate can be determined "manually," i.e., by observation of fiducial marks using a microscope and a crosshair.

The nozzles 18 are adapted to deliver droplets to target points 20 (see FIG. 1) on the substrate 25. In some embodiments, the means for determining an angular rotation of the substrate 25 in a coordinate system comprise a second camera 35.

The substrate 25 has a top surface and alignment marks 40. The nozzles 18 have droplet delivery openings oriented towards the substrate 25 for delivery of the droplets on the substrate. The first camera 30 is oriented substantially towards the nozzle 18 openings. The second camera 35 is oriented substantially towards the substrate 25 top surface.

Figure 2:
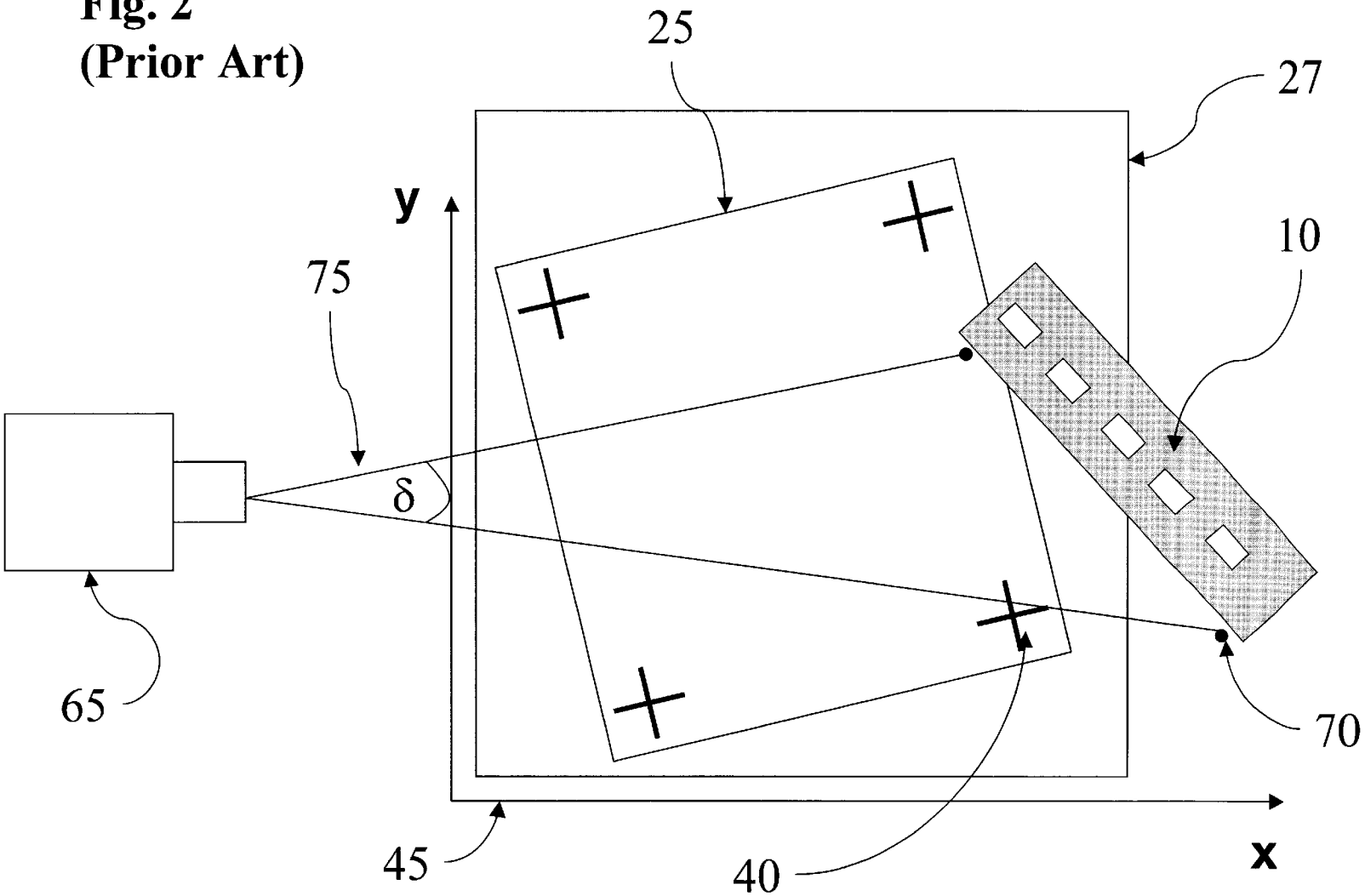
Fig. 2 (Prior Art)
FIG. 2 illustrates a prior art method of aligning nozzles in a print head.

Some prior art printing tools, as shown in FIG. 2, also use alignment marks 40 on the substrate 25. In the prior art, the alignment marks 40 are first used to adjust the substrate 25 relative to the axes of a coordinate system 45 to set a first (substrate) angle ($\alpha$) 50 (see FIG. 4) by using a rotary stage (not shown). After setting the first angle 50 to zero, a second (nozzle array—$\gamma$) angle 55 is adjusted. In some embodiments, the nozzle array angle 55 is defined by the rotational separation of the major axis 60 of the print head 10 from the x-axis of the coordinate system 45. To adjust the second angle 55, a print head viewing camera 65 views a print head 10 surface to detect alignment points 70. The alignment points 70 are disposed on the print head 10. The nozzle array angle 55, is then calculated based on the view angle 75.

Some embodiments use two separate cameras to align a nozzle array. As shown in FIG. 3, a downward looking camera 30 can be disposed in a fixed position relative to the print head 10. Camera 30 can then be used to align the substrate 25 through determination of the substrate angle 50 enclosed by the substrate and the x-axis of the fixed coordinate system 45. Camera 30 is in a downward looking orientation in the embodiment depicted by FIG. 4. But, the downward looking orientation is not a critical limitation for camera 30. Instead, for some embodiments, camera 30 can be positioned to view the alignment marks 40 disposed on the substrate 25. In a preferred embodiment, downward looking camera 30 is disposed having a focal plane within a rotational displacement relative to the substrate 25 plane of approximately 5 to 175 degrees.

In some embodiments as shown in FIG. 3, an additional upward looking camera 35 is mounted in a fixed position relative to the substrate 25. Camera 35 can be used to determine the coordinates of the nozzles 18, instead of the coordinates of the frame of the print head 10 as in earlier systems. Camera 35 is in an upward looking position in the embodiment depicted by FIG. 4. But, this orientation is not a critical limitation. Instead for some embodiments of the invention, camera 35 can be oriented to view the nozzle 18 openings, or nozzle alignment features corresponding to the nozzles. In a preferred embodiment, upward looking camera 35 is disposed having a focal plane within a rotation displacement relative to a plane formed by selected nozzles 18 of approximately 5 to 175 degrees. Commercially available CCD cameras having suitable optics, such as those used in the ImageXpert system, can be used to implement these embodiments. In one embodiment, the entire ImageXpert system can be used instead of the upward looking camera 35 thereby providing the optical system plus image recognition software for automatic detection of the nozzles.

Figure 4:
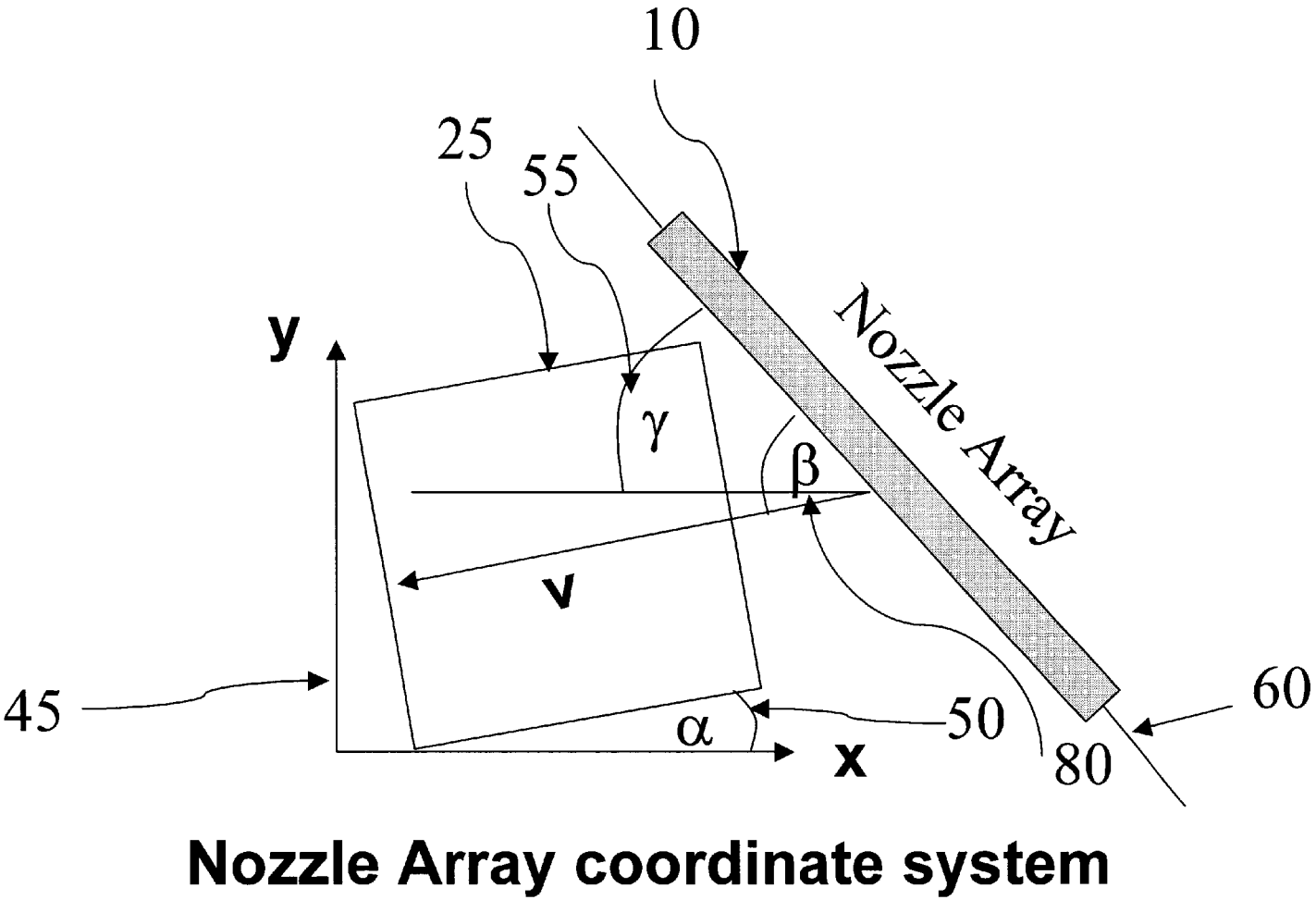
FIG. 4 illustrates a print head with a substrate that is also rotationally displaced relative to a coordinate system.
Figure 5:
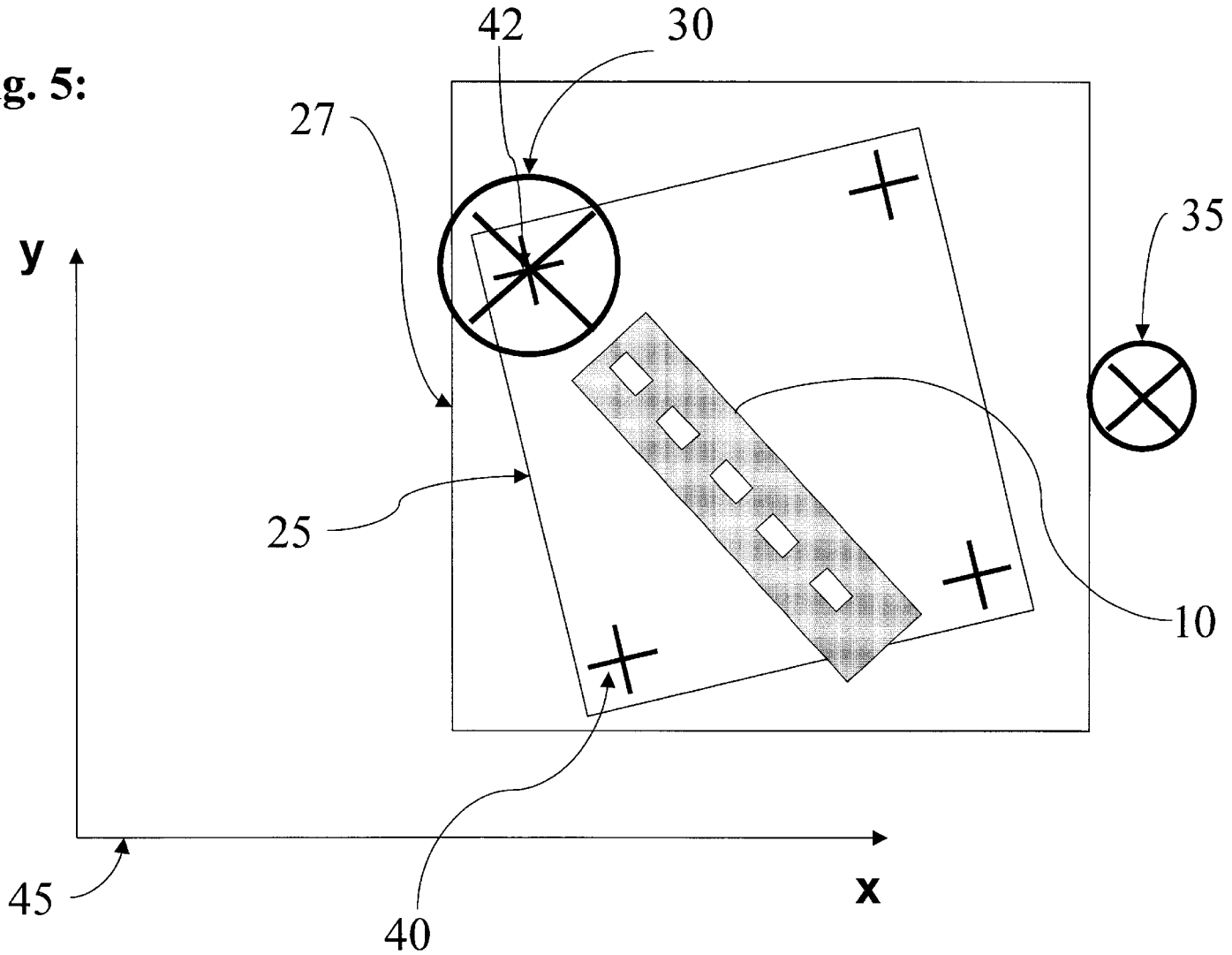
FIG. 5 illustrates the placement of the downward looking camera over an alignment mark to obtain stage coordinates x2, y2, according to a process step of one embodiment of the invention.

The combination of the two alignment procedures described below, in the Method for delivering droplets section, allows for a precise determination of the angular relation between the substrate 25 and the nozzle 18 array disposed on the print head 10, i.e., the nozzle array/substrate angle ($\beta$) 80 that is shown in FIG. 4.

Some embodiments include a substrate chuck mounted on a substrate stage 27, and a print head 10 mounted at a fixed position. However, the procedure is easily transferable to a setup with a fixed-position substrate 25 and a nozzle 18 array mounted to a nozzle array stage (not shown). Alternatively, the substrate 25 can be fixed in the x-direction and movable in the y-direction, while the nozzle 18 array can be fixed in the y-direction and movable in the x-direction; or vice-versa for the substrate and the nozzle array.

In some embodiments the droplets can be delivered on the substrate to form at least one of organic light emitting devices, organic thin film transistors, organic solar cells, electronic devices comprising both organic and inorganic materials, and hybrid TFT, and hybrid diode devices. The organic light emitting devices can comprise an array at least of one of a high-resolution passive matrix and a high-resolution active matrix display.

In some embodiments the droplets can comprise at least one of a liquid solution of one or more polymers, a dispersion of one or more polymers, a liquid solution of one or more oligomers, a dispersion of one or more oligomers, a liquid solution of one or more small molecules, and a dispersion of one or more small molecules.

In some embodiments the droplets can be adapted to act as at least one of print emissive materials, charge transporting materials, charge-injecting materials, charge-conducting materials, and light-emissive materials. The light-emissive materials can comprise electro-luminescent polymers based on the poly(phenylene-vinylene) (PPV) backbone; polymers based on the fluorene backbone; poly(phenylene-vinylene) copolymers, fluorene copolymers, and copolymers comprising combinations of poly(phenylene-vinylene) polymers and fluorene polymers. The charge-conducting polymers can comprise at least one of doped polyaniline solutions, doped polyethylene-dioxy-thiophene solutions, and polyethylene-dioxy-thiophene solutions doped with polystyrene sulfonic acid.

For some embodiments as depicted in FIG. 3, alignment marks 40 are arranged on the substrate 25 so that the substrate angle 50 can be determined by detecting the position of at least two of the alignment marks. In a preferred embodiment, the alignment mark 40 spacing is large enough to provide delivery of droplet dots within approximately 0.1 to 30 micrometers of their desired position. (See the Example provided below after the Method for delivering droplets section.)

Method for Delivering Droplets

Another embodiment provides a method for delivering droplets on a substrate. The method comprises providing nozzles, obtaining an angular displacement value in a coordinate system, sequentially placing the nozzles in a position in a viewing area of a first camera, registering sets of coordinates in the coordinate system, and determining an angular rotation of the nozzles. In some embodiments the method also includes delivering droplets on the substrate from at least one of the nozzles.

The nozzles include a first nozzle and a second nozzle, and are disposed in proximity of the substrate. The angular displacement corresponds to at least two alignment marks. The alignment marks are disposed on the substrate. The first nozzle and the second nozzle each have at least one opening for the delivery of droplets. The first camera is oriented substantially towards the nozzle openings. Each set of coordinates is associated with one of the nozzles. The angular rotation values (gamma) of the first nozzle and the second nozzle are provided in the coordinate system.

According to some embodiments, a first step of an alignment procedure includes moving the substrate stage 27 until a first alignment mark 41 is centered in the downward looking camera 30. Upon centering camera 30 on alignment mark 41, the stage coordinates x1 and y1 are registered. In a following step, the substrate stage 27 is moved until a second alignment mark 42 is located underneath the same camera (FIG. 3). The coordinates are registered again (x2 and y2), and the substrate angle 28 ($\alpha$) (see FIG. 4) of the substrate in the coordinate system 45 can be determined by a simple trigonometric calculation, i.e., $\tan \alpha=(y1-y2)/(x1-x2)$. Further alignment marks can be used in order to enhance the precision of the angle measurement. This technique of determining the substrate position/rotation has been used in prior art printing systems.

Figure 6:
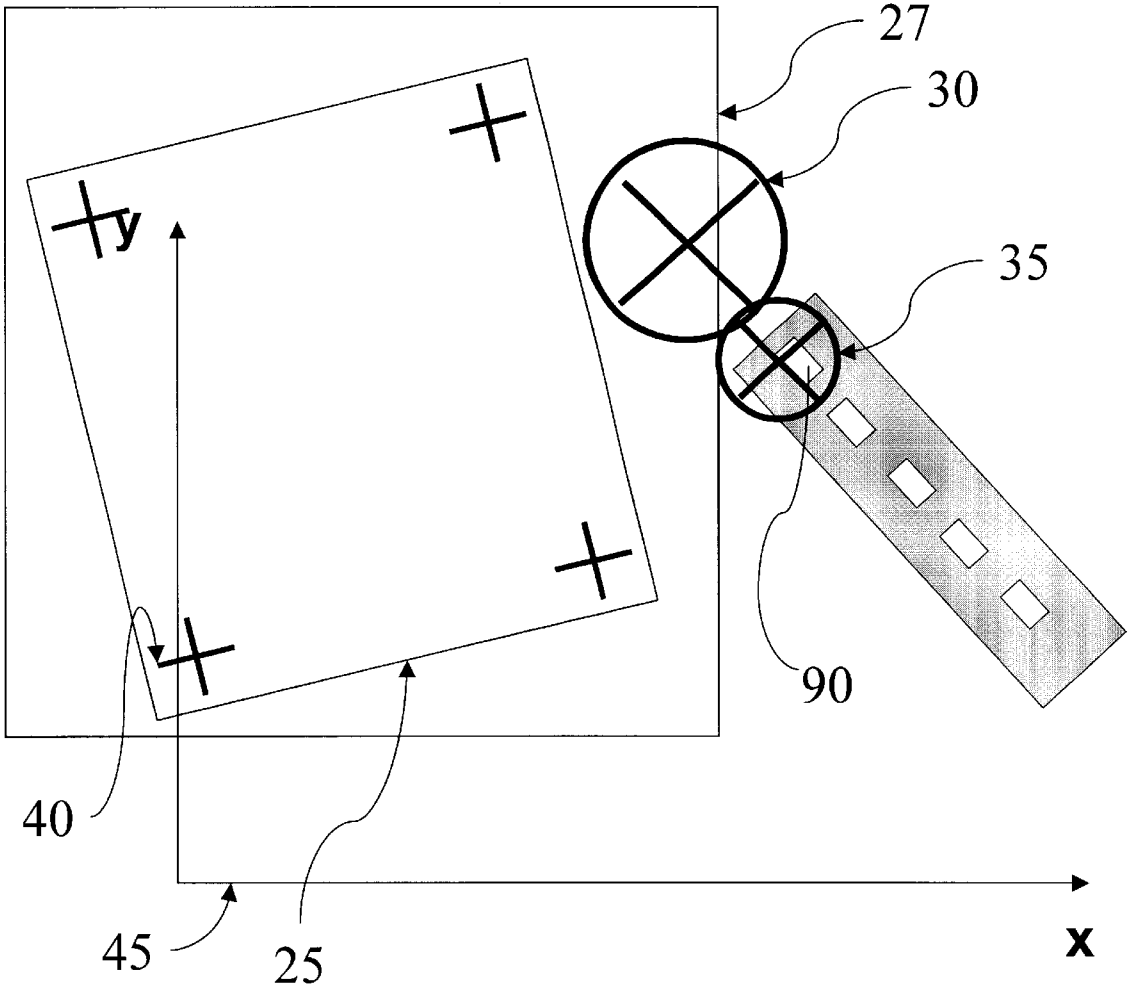
FIG. 6 illustrates the placement of the upward looking camera over a first nozzle to obtain stage coordinates x3, y3, according to a process step of one embodiment of the invention.

As shown in FIG. 6, some embodiments include a second upward looking camera 35. The substrate stage 27 can be moved until the first nozzle 18*a* of the print head 10 array is located above the center of the upward looking camera 35. When this occurs, the first nozzle coordinates 90 (x3 and y3) are registered. Accordingly, the coordinates 95 (x4 and y4) of the last nozzle 18*b* of the array are determined, as described in FIG. 7. The nozzle array angle 55 ($\gamma$) of the nozzle 18 array relative to the x-axis of the coordinate system 45 is now easily determined by a trigonometric calculation, i.e., $\tan \gamma=+/-(y3-y4)/(x3-x4)$.

Figure 7:
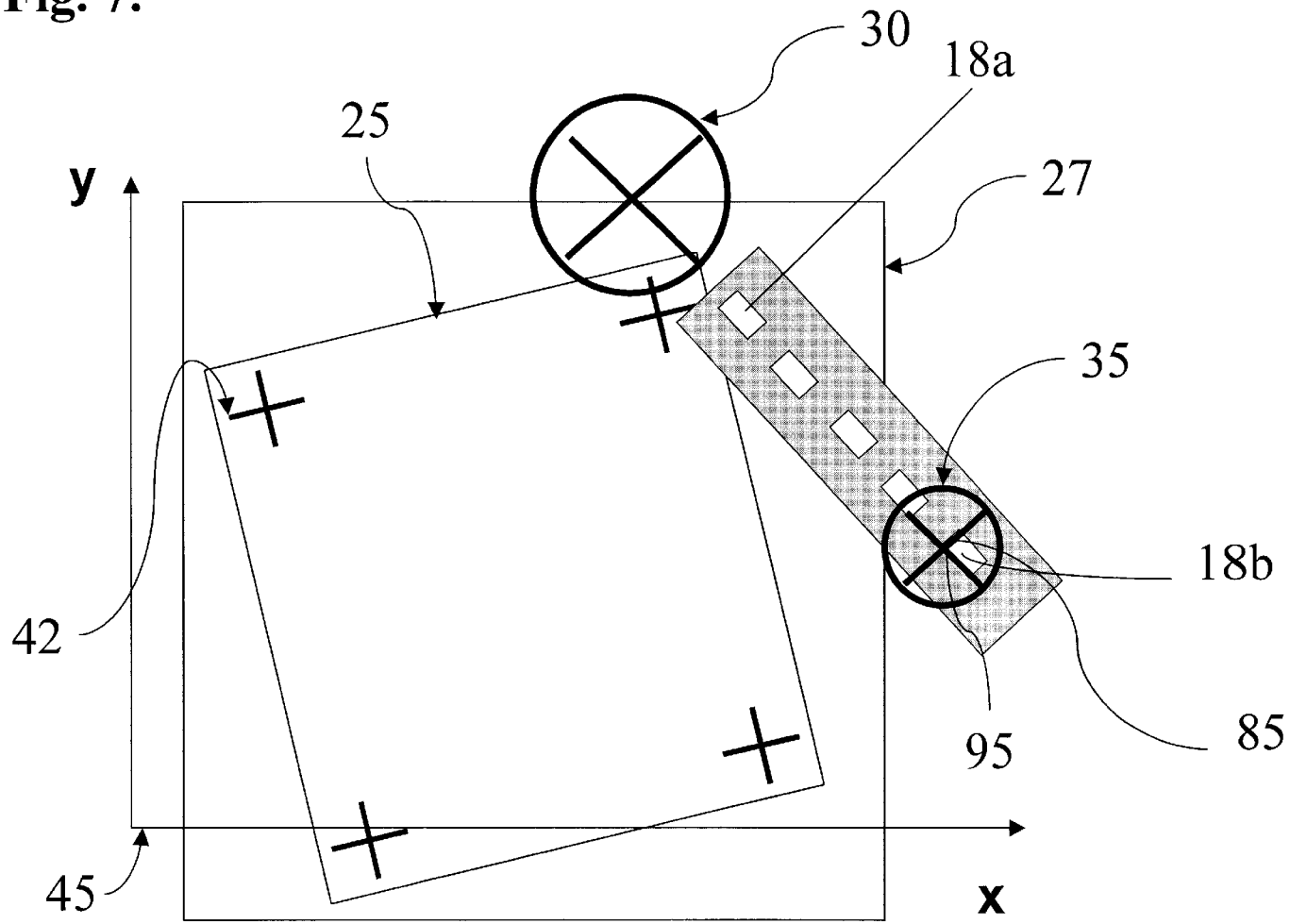
FIG. 7 illustrates the placement of the upward looking camera over a last nozzle to obtain stage coordinates x4, y4, according to a process step of one embodiment of the invention.

Instead of the first nozzle 18*a* and the last nozzle 18*b*, other nozzles of the array can be used. Increasing the number of nozzle coordinates increases the accuracy of the calculation of angle 55. The accuracy of this measurement can also be increased be using small characteristic nozzle alignment features 85 as target points for coordinate determination, such as a certain corner of the opening for the rectangular nozzle orifices, as shown in FIG. 7, and by using image recognition applications and associated hardware elements. Image recognition applications that can be used with this embodiment include XCaliper, Optimas. The image recognition systems can either detect dark or light areas (with adjustable threshold), distinguishing the nozzle orifice from the background of the nozzle plate, and determine the center point of the nozzle opening. In other embodiments, the software can be "taught" to search for a certain geometric shape, such as for a rectangular or circular nozzle orifice in the image provided by the camera.

As indicated in FIG. 4, the precise nozzle array/substrate angle 80 ($\beta$) of the nozzle 18 array with respect to the substrate 25 can now be determined by adding the measured nozzle array angle 55 ($\gamma$) and the measured substrate angle 50 ($\alpha$). No mismatches due to improper machining of the substrate 25 mount or the print head 10 mechanics degrade the precision of this alignment procedure.

EXAMPLE

In one example of the invention, the goal is to print lines with a spacing of 353.55 micrometers onto a substrate. Using a print head with a physical nozzle pitch of 500 micrometers, we can use an angle of 45 degrees between the substrate and the nozzle array. If we allow for a misplacement of droplets between neighboring print lines (353.55 micrometers+/−misplacement) of 10 micrometers, we can allow for a maximum angular error of 10 micrometers/(500 micrometers*cos 45)=0.02828 radians=1.6 degrees. This maximum angular error includes the uncertainty of the determination of the nozzle array angle and of the substrate angle; both of which add quadratically to the overall error.

Print Head Suitability Assessment Method

Another embodiment provides a method to assess the suitability of a print head for manufacturing comprising obtaining an angular displacement value corresponding to at least two alignment marks, sequentially placing a first nozzle and a second nozzle within a viewing area of a first camera, registering sets of coordinate data associated with the nozzles, determining angular rotation data corresponding to the first nozzle and the second nozzle, and comparing the sets of coordinate data and the angular rotation data to predetermined suitability values.

At least one nozzle has at least one droplet delivery opening. The angular displacement value corresponds to at least two alignment marks. The alignment marks are disposed on a substrate. The first camera faces substantially towards the nozzle openings. Each set of coordinate data is associated with one of the nozzles.

In some embodiments of the suitability assessment method, on-line statistics of the manufacturing precision of the nozzle plate are obtained. Such statistics enable the nozzle array user to eliminate faulty and off-specification print heads 10. This is a very useful feature in inkjet machines used for high-volume manufacturing of displays. The nozzle plate statistics can be supported by a computer, using automatic pattern recognition software. The statistics can be generated by storing a nozzle position for each nozzle, calculating a separation between neighboring nozzles, i.e., $(d_{i,i+1}=\mathrm{Sqrt}((x_{i+1}-x_i)^2+(y_{i+1}-y_i)^2))$ or similar statistical algorithms, determining an average and a standard deviation of these nozzle separations, and then comparing the statistics with manufacturer's specifications.

Various additions, modifications and rearrangements of the features of the invention may be made without deviating from the spirit and scope of the underlying inventive concept. It is intended that the scope of the invention as defined by the appended claims and their equivalents cover all such additions, modifications, and rearrangements. The appended claims are not to be interpreted as including means-plus-function limitations, unless such a limitation is explicitly recited in a given claim using the phrase "means-for." Expedient embodiments of the invention are differentiated by the appended claims.

What is claimed is:

1. A system for delivering droplets on a substrate, the substrate having a top surface, the system comprising:

nozzles adapted to deliver droplets to target points on the substrate, the substrate having alignment marks, the nozzles having droplet delivery openings oriented towards the substrate for delivery of the droplets;

a first camera oriented substantially towards the nozzle openings; and a second camera oriented substantially towards the substrate top surface, wherein the first camera is used to determine an angular displacement.

2. The system of claim 1, wherein the alignment marks are disposed on the substrate to enable substrate rotation determination through detection of at least two of the alignment marks.

3. The system of claim 1, wherein:

the nozzles are disposed on a print head; and the print head is mounted in a fixed position.

4. The system of claim 3, wherein the substrate is mounted on an x-y stage.

5. The system of claim 1, wherein the substrate is mounted in a fixed position.

6. The system of claim 5, wherein the nozzles are disposed on a print head and the print head is mounted on an x-y stage.

7. The system of claim 1, wherein the droplets comprise at least one of: a liquid solution of one or more polymers, a dispersion of one or more polymers, a dispersion of one or more oligomers, a liquid solution of one or more small molecules, and a dispersion of one or more small molecules.

8. The system of claim 1, wherein the droplets are delivered on the substrate to form at least one of organic light emitting devices, organic thin film transistors, organic solar cells, electronic devices comprising both organic and inorganic materials, and hybrid TFT, and hybrid diode devices.

9. The system of claim 8, wherein the organic light emitting devices comprise an array at least of one of a high-resolution passive matrix and a high-resolution active matrix display.

10. The system of claim 1, wherein the droplets are adapted to function as at least one of: print emissive materials, charge transporting materials, charge-injecting materials, charge-conducting materials, and light-emissive materials.

11. The system of claim 10, wherein the charge-conducting materials comprise at least one of doped polyaniline solutions, doped polyethylene-dioxy-thiophene solutions, and polyethylene-dioxy-thiophene solutions doped with polystyrene sulfonic acid.

12. The system of claim 10, wherein the light-emissive materials comprise at least one of electro-luminescent polymers and copolymers.

13. The system of claim 12, wherein the electro-luminescent polymers comprise at least one of polymers based on a poly(phenylene-vinylene) backbone, polymers based on a fluorene backbone, poly(phenylene-vinylene) copolymers, fluorene copolymers, and copolymers comprising combinations of poly(phenylene-vinylene) polymers and fluorene polymers.

14. The system of claim 1, wherein the maximum tolerance for delivery of the droplets is between approximately 0.1 micrometers and approximately 30 micrometers.

15. A method for delivering droplets on a substrate comprising:

providing nozzles including a first nozzle and a second nozzle, the nozzles disposed in proximity of the substrate;

obtaining an angular displacement value in a coordinate system, the angular displacement corresponding to at least two alignment marks, the alignment marks disposed on the substrate;

sequentially placing the first nozzle and the second nozzle in a position in a viewing area of a first camera, the first nozzle and the second nozzle each having at least one opening for the delivery of droplets, the first camera oriented substantially towards the nozzle openings;

registering sets of coordinates in the coordinate system, each set of coordinates associated with one of the nozzles; and determining an angular rotation (gamma) of the first nozzle and the second nozzle in the coordinate system.

16. The method for delivering droplets of claim 15, wherein:

the sequentially placing step includes moving the first nozzle until the first nozzle is disposed in the position in the viewing area of the first camera;

the registering step includes registering a first set of coordinates in the coordinate system corresponding to the first nozzle;

the sequentially placing step includes moving the second nozzle until the second nozzle is disposed in the position in the viewing area of the first camera; and the registering step includes registering a second set of coordinates in the first coordinate system corresponding to the second nozzle.

17. The method for delivering droplets of claim 15, wherein obtaining a first angular displacement value further comprises:

moving the substrate until a first alignment mark disposed on the substrate is disposed in a first position in a viewing area of a second camera, the second camera facing substantially towards the top surface of the substrate;

registering a set of coordinates in the coordinate system, the set of coordinates corresponding to the first alignment mark;

moving the substrate until a second alignment mark disposed on the substrate is disposed in the first position within the viewing area of the first camera;

registering another set of coordinates in the coordinate system, the other set of coordinates corresponding to the second alignment mark;

determining an angular rotation (alpha) of the substrate in the coordinate system.

18. The method of claim 15, wherein the first nozzle is disposed at one end of a nozzle array and the second nozzle is disposed at the opposite end of the nozzle array.

19. The method of claim 15, further comprising:

determining the number (n) of nozzles required to attain a desired tolerance for alignment of a printhead;

repeating the sequentially placing, registering, and determining steps for each of the n nozzles.

20. The method of claim 15, further comprising delivering droplets on the substrate from at least one of the nozzles.

21. A method for assessment of the suitability of a print head for manufacturing, the print head having at least a first nozzle and a second nozzle, the first nozzle having at least one droplet delivery opening, the method comprising:

a) obtaining an angular displacement value in a coordinate system, the angular displacement value corresponding to at least two alignment marks, the alignment marks disposed on a substrate;

b) sequentially placing the first nozzle and the second nozzle within a viewing area of a first camera, the first camera facing substantially towards the nozzle openings;

c) registering sets of coordinate data in the coordinate system, each set of coordinate data associated with one of the nozzles;

d) comparing the sets of coordinate data and the angular rotation data to predetermined suitability values, the comparing step is performed within a system for delivering droplets.

22. The method of claim 21, wherein the comparing step includes determining the suitability values by:

e) storing the coordinate data and the angular rotation data;

f) repeating steps a through d and c for a statistically significant number of print heads; and g) applying statistical criteria to identify print heads that provide yield values below an established threshold value.

23. The method of claim 22, wherein the placing and registering steps are performed using automatic image recognition software.

24. A system for delivering droplets on a substrate, the substrate having a top surface, the system comprising:

nozzles adapted to deliver droplets to target points on the substrate, the substrate having alignment marks, the nozzles having droplet delivery openings oriented towards the substrate for delivery of the droplets;

a first camera oriented substantially towards the nozzle openings; and means for determining an angular rotation of the substrate in a coordinate system, wherein the first camera is used to determine an angular displacement value.

25. The system of claim 24, wherein the means for determining an angular rotation comprise a second camera oriented substantially towards the substrate top surface.

26. The system of claim 24, wherein the droplets comprise at least one of a liquid solution, a dispersion of one or more polymers, a dispersion of one or more oligomers, a liquid solution of small molecules, and a dispersion of small molecules.

* * * * *